US006265955B1

(12) United States Patent
Molyneux et al.

(10) Patent No.: US 6,265,955 B1
(45) **Date of Patent: *Jul. 24, 2001**

(54) HERMETICALLY SEALED ELECTROMAGNETIC RELAY

(76) Inventors: Michael H. Molyneux, 318 Elizabeth St., Santa Barbara, CA (US) 93103; Bernard V. Bush, 3914 Carol Ave., Santa Barbara, CA (US) 93110

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/913,150

(22) PCT Filed: Feb. 27, 1997

(86) PCT No.: PCT/US97/03119

§ 371 Date: Mar. 2, 1998

§ 102(e) Date: Mar. 2, 1998

(87) PCT Pub. No.: WO97/32325

PCT Pub. Date: Sep. 4, 1997

Related U.S. Application Data

(60) Provisional application No. 60/012,337, filed on Feb. 27, 1996.

(51) Int. Cl.[7] ..... H01H 67/02

(52) U.S. Cl. ..... 335/128; 335/202; 200/304

(58) Field of Search ..... 335/78–86, 124, 335/128, 126, 132, 151–4; 200/302.1, 304, 305

(56) References Cited

U.S. PATENT DOCUMENTS

| | | | |
|---|---|---|---|
| 2,369,331 | | 2/1945 | Baker . |
| 2,523,335 | | 9/1950 | Schroy et al. . |
| 2,523,336 | | 9/1950 | Schroy et al. . |
| 3,250,886 | | 5/1966 | De Lucia et al. . |
| 3,267,247 | | 8/1966 | Ross . |
| 3,411,118 | | 11/1968 | Fellows et al. . |
| 3,567,887 | | 3/1971 | Maloney . |
| 3,676,621 | | 7/1972 | Pflanz . |
| 3,780,354 | | 12/1973 | Sharp . |
| 3,812,314 | | 5/1974 | Nonken . |
| 3,813,506 | | 5/1974 | Mitchell . |
| 3,958,199 | * | 5/1976 | Seitz, Jr. et al. ..... 335/151 |
| 4,052,577 | | 10/1977 | Votta . |
| 4,079,219 | | 3/1978 | Weston . |
| 4,168,480 | | 9/1979 | De Lucia . |
| 4,210,774 | | 7/1980 | Perry . |
| 4,309,816 | | 1/1982 | Takeyama et al. . |
| 4,383,150 | | 5/1983 | Cromer et al. . |
| 4,516,004 | | 5/1985 | Bany et al. . |
| 4,565,901 | | 1/1986 | Hirooka et al. . |
| 4,591,678 | | 5/1986 | Yin . |
| 4,879,441 | | 11/1989 | Hamm et al. . |
| 4,880,947 | | 11/1989 | Fey et al. . |
| 5,554,963 | * | 9/1996 | Johler et al. ..... 335/151 |

OTHER PUBLICATIONS

Charles A. Popeck, P.E., A.B. Chance Company, "The Development of an Encapsulated Loadbreak Vacuum Switch for Underground Distribution Sectionalizing"; pp. 3–5

* cited by examiner

*Primary Examiner*—Lincoln Donovan
(74) *Attorney, Agent, or Firm*—Christie, Parker & Hale, LLP

(57) ABSTRACT

Sealed relays intended for high-voltage or high-power switching are enclosed in a herrnetically sealed plastic housing or jacket (11) capable of long-term maintenance of either a high vacuum or a pressurized insulating gas within the relay to suppress contact arcing during switching. The impermeable plastic housing eliminates need for conventional glass or ceramic contact enclosures, and enables use of inexpensive relays (71) in demanding applications.

4 Claims, 11 Drawing Sheets

13
10
12
11
14
15
16
17

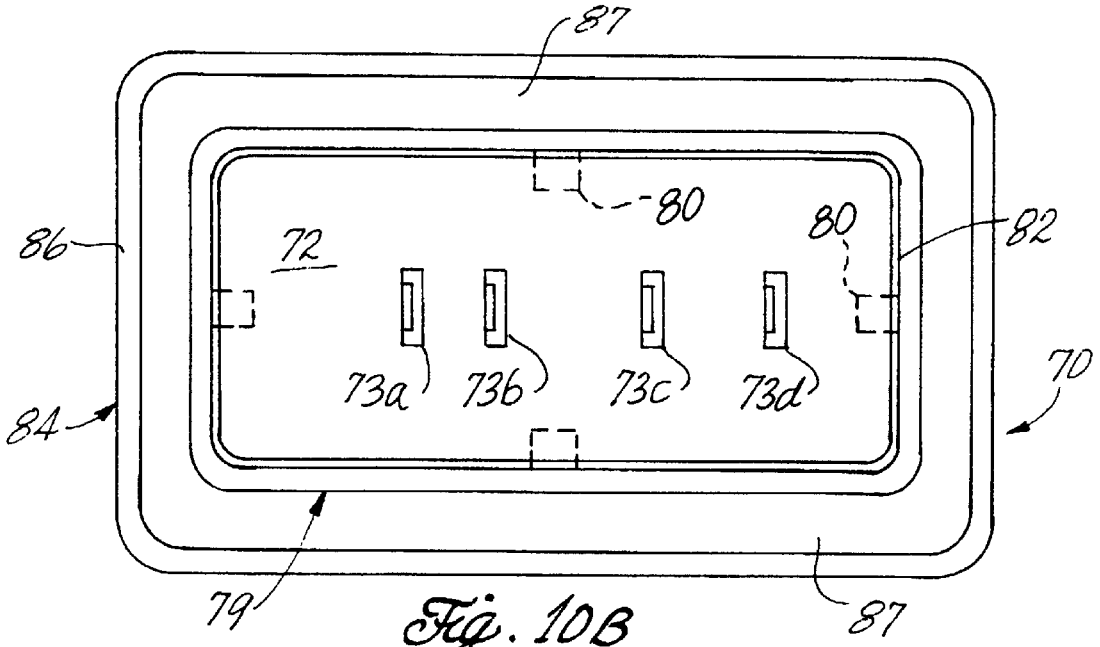
Fig. 10B
Fig. 10A
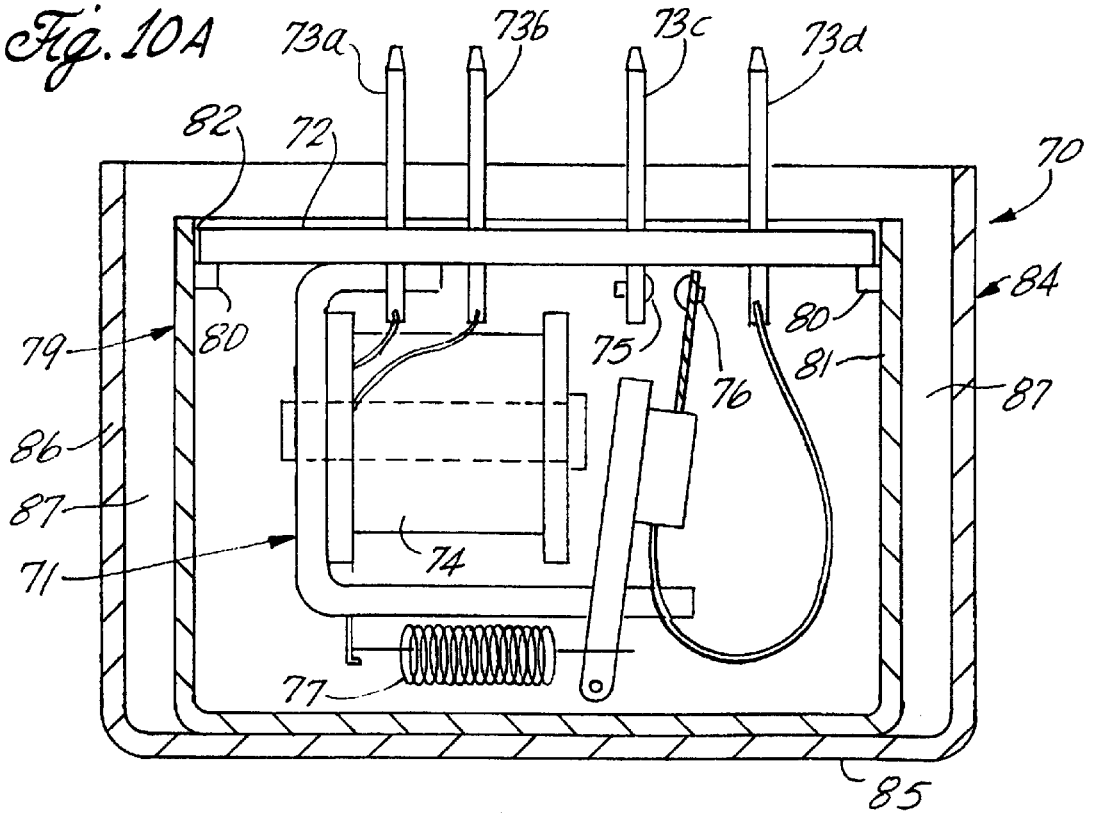

HERMETICALLY SEALED ELECTROMAGNETIC RELAY

CROSS REFERENCE TO RELATED APPLICATION

This application is a continuation in part of U.S. Provisional Patent Application No. 60/012,337 filed Feb. 27, 1996.

BACKGROUND OF THE INVENTION

Hermetically sealed electromagnetic relays are used for switching of high electrical currents and/or high voltages, and typically have fixed and movable contacts, and an actuating mechanism supported within a hermetically sealed chamber. To suppress arc formation, and to provide long operating life, air is removed from the sealed chamber by conventional high-vacuum equipment and techniques. In one style of relay, the chamber is then sealed so the fixed and movable contacts coact in a high-vacuum environment. In another common style, the evacuated chamber is backfilled (and sometimes pressurized) with an insulating gas (e.g., sulphur hexafluoride) with good arc-suppressing properties.

The sealed chamber is conventionally formed by a glass or ceramic envelope which is fused (glass-to-metal seal) or brazed (ceramic-to-metal seal) to metal components of the relay such as terminal pins and a typically cylindrical or tubular metal base. These fused or brazed junctions are specified by Military Specification MIL-R-83725 with respect to high-voltage sealed relays.

Properly selected grades of glass or ceramic provide the essential characteristics of low gas permeability, excellent insulating or dielectric qualities, low outgassing, and mechanical strength. Glass envelopes, however, are handmade by skilled artisans, and are expensive and subject to breakage, and ceramic envelopes are both expensive to press and metalize, and difficult to procure. It is to the solution of these problems that our invention is directed.

Our improvement is directed to the replacement of these glass or ceramic chamber-enclosing envelopes with an inexpensive and easily formed vacuum-tight assembly of plastic and epoxy, or in an alternative form, an envelope made entirely of epoxy. We have established that this type of plastic/epoxy or epoxy envelope provides an excellent hermetic seal, good dielectric and outgassing characteristics, and a strong, inexpensive sealed relay for switching high currents and/or high voltage.

Attempts have been made in known designs to use plastic materials in relays, and U.S. Pat. Nos. 4,039,984, 4,168,480 and 4,880,947 are examples of the use of epoxy resins as adhesives to secure together relay housing components. Curing of the epoxy to a cross-linked thermoset state shrinks the joint bond and weakens the seal. Certain other designs (e.g., U.S. Pat. 5,554,963) have used thermoplastic (as opposed to cross-linked thermosetting) polymers, but the resulting relay envelope is not a true hermetic seal which can maintain either a high-vacuum or high-pressure environment.

For purposes of this invention disclosure, a hermetic seal means a seal which is sufficiently strong and impermeable to maintain for a long term a high vacuum of $10^{-5}$ Torr (760 Torr=one atmosphere) or less, and a pressure of at least 1.5 atmospheres. In contrast to the prior-art designs, the present invention achieves hermetic sealing by encapsulating the relay chamber in a jacket of impermeable epoxy or a comparable thermosetting polymer, the jacket having single-junction epoxy-to-metal bonds. Shrinkage of the epoxy during polymerization is a significant advantage in the invention as it provides a strong and reliable single-junction seal.

In one embodiment described below, an unsealed relay is encapsulated in a vacuum chamber, thus eliminating the need for an evacuation tube which characterizes prior relay designs. This same new method can be used to make pressurized relays which are evacuated, backfilled and encapsulated within a properly equipped chamber.

SUMMARY OF THE INVENTION

This invention is directed to the replacement of glass or ceramic contact-enclosing housings in sealed relays with an economical thermosetting-plastic jacket which is impermeable to inflow of air in a high-vacuum relay, and to outflow of insulating gas in a backfilled and pressurized relay. Epoxy is a presently preferred material because it forms hermetic seals with impermeable metal components (such as terminals) which must extend through the jacket, and is substantially impermeable to gasses of small molecular size such as hydrogen.

DESCRIPTION OF THE DRAWINGS

FIGS. 10A and 10B are respectively a sectional side elevation and a top view of second embodiment of the invention using an open-frame relay in a plastic cup supported in an outer metal cup, the assembly being shown before encapsulation;

DETAILED DESCRIPTION OF THE PREFERRED EMBODIMENTS

Figure 1:
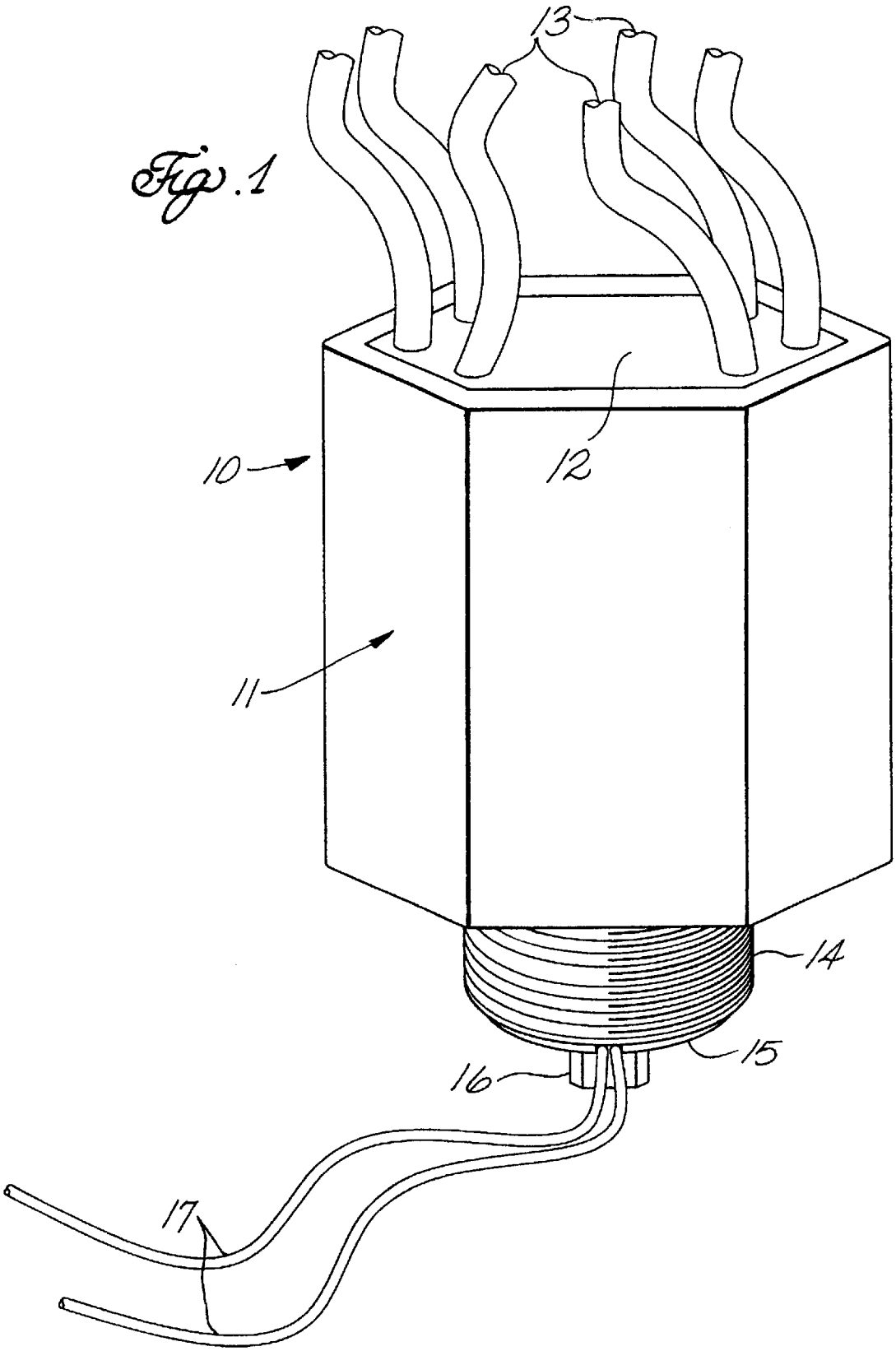
FIG. 1 is a perspective view of a sealed relay according to the invention.

FIG. 1 shows a sealed relay 10 using a plastic and epoxy-sealed envelope to enclose the fixed and moving contacts of the relay. A primary external sidewall of the relay is formed by a plastic potting cup 11 which serves as a mold to hold epoxy material 12 poured into the cup and cured to provide a hermetic seal. Insulated electrical leads 13 extend through the epoxy material for connection of fixed and movable contacts to external circuitry. A threaded metal mounting base 14 extends through the underside of cup 11, and has a lower end closed by a metal cover plate 15 secured by a nut 16, and through which a pair of actuating-coil leads 17 extend for connection to external circuitry.

The concepts of the invention are useful in many different styles of hermetically sealed relays (whether of a high-vacuum type, or a back-filled or pressurized type), and will be described in the context of a double-pole double-throw relay using a conventional and typical electromagnetic actuator and fixed and movable contact assemblies. The invention is not limited to this specific configuration which is illustrated only by way of example, and is equally applicable to other types of sealed relays.

Figure 2:
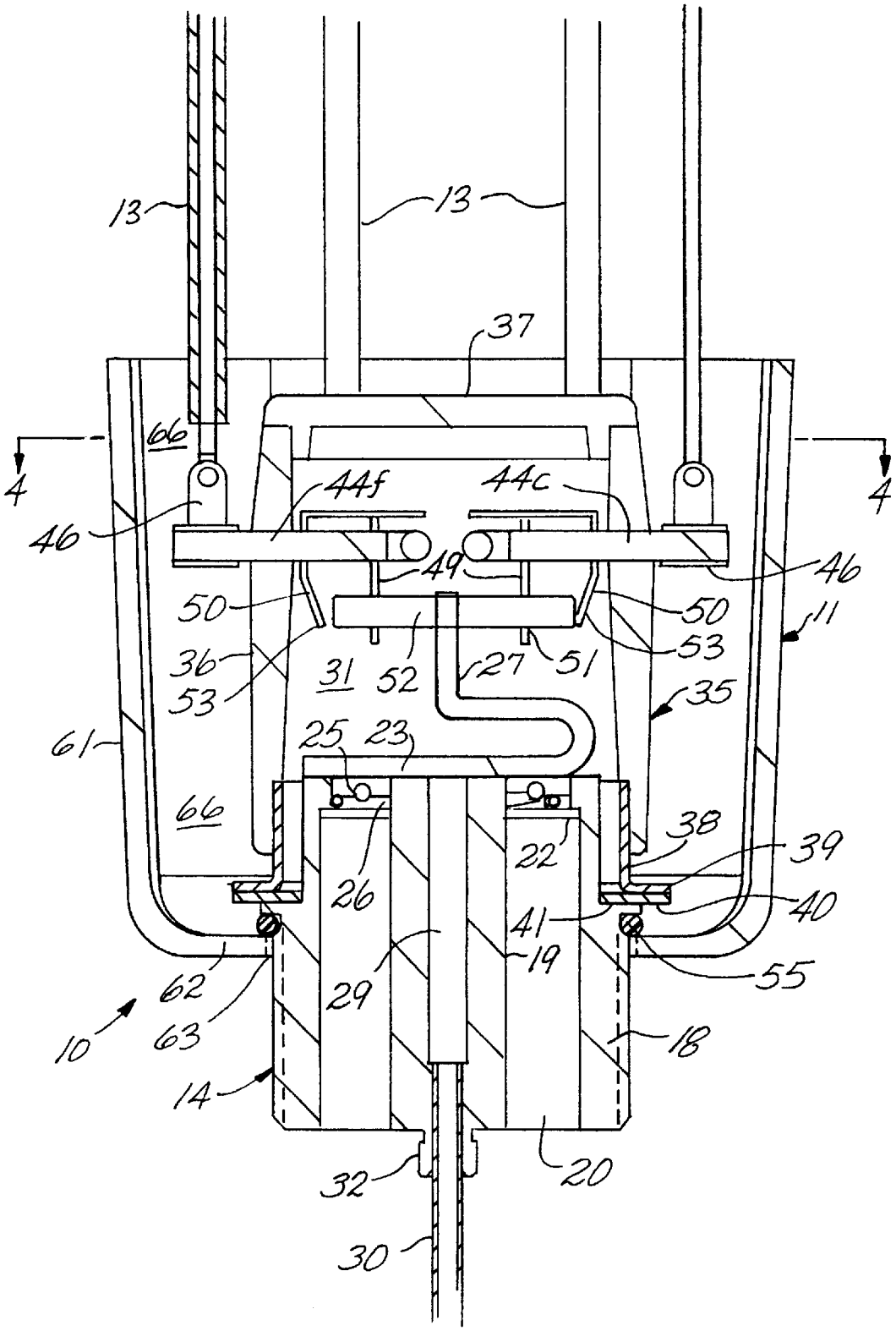
FIG. 2 is an enlarged sectional elevation of the relay before encapsulation, on line 2—2 of FIG. 5.
Figure 3:
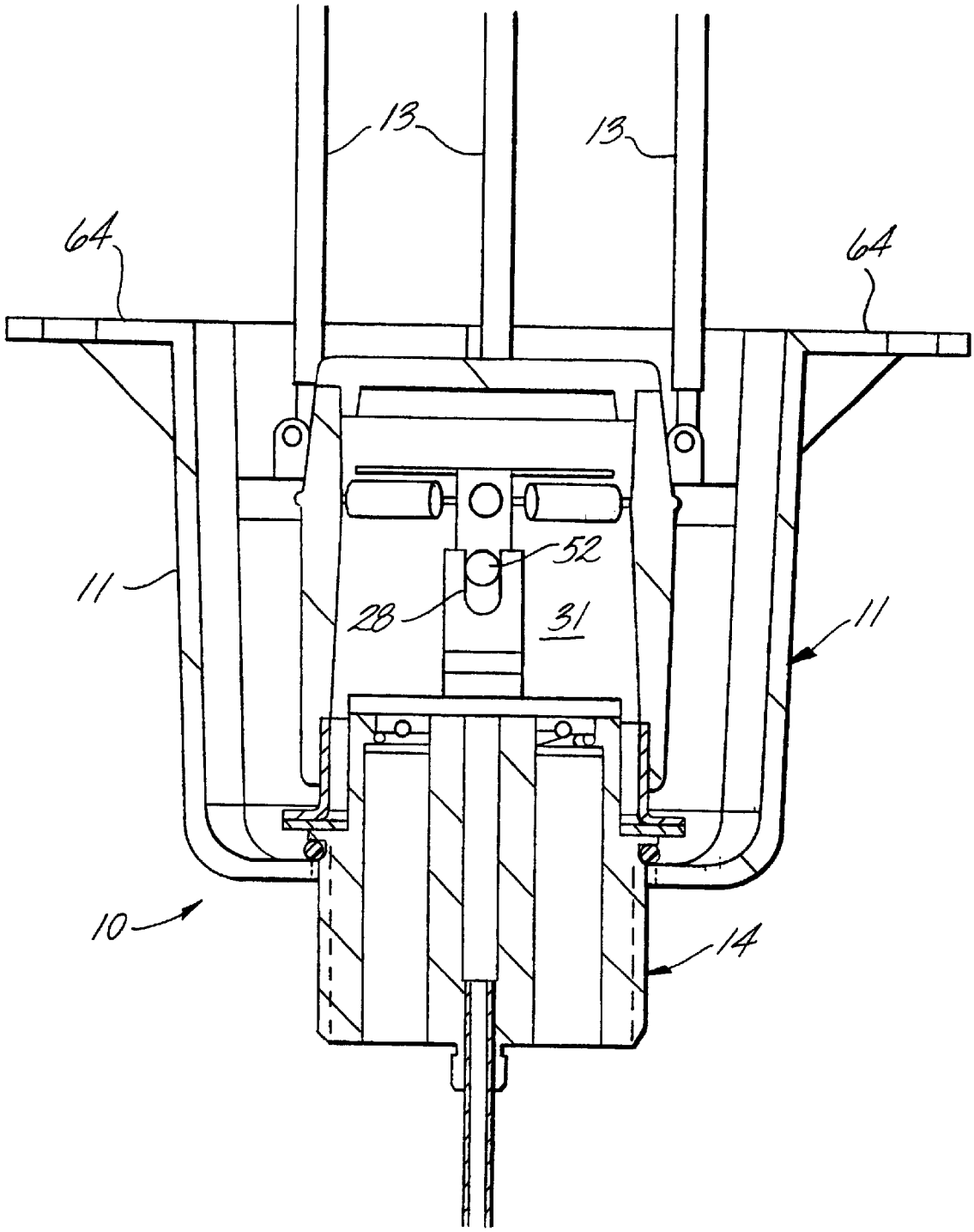
FIG. 3 is a reduced sectional elevation of the relay on line 3—3 of FIG. 5.

Referring to the sectional elevations of FIGS. 2 and 3, base 14 (made of a high-permeability magnetic-metal alloy such as C1018 iron) has a cylindrical sidewall 18, a central cylindrical pole piece 19, and an annular space 20 between the sidewall and pole piece into which is fitted a conventional actuating coil (not shown). The upper end of space 20 is closed by a washer-like disk 22 made of a non-magnetic material such as monel metal, and which is brazed to the sidewall and pole piece to provide a hermetic seal.

A movable armature 23 is pivotally mounted to the top of the base by a hinge (not shown). A coil spring 25 is seated in an annular space 26 between the upper ends of the sidewall and pole piece above disk 22, and urges the armature away from the pole piece when the relay is in a nonenergized condition. The armature has an upwardly extending actuating leg 27 with a slot 28 (FIG. 3) at its upper end. The pole piece has a central bore 29 extending to an evacuation tube 30 brazed and hermetically sealed to the pole piece, and through which a sealed chamber 31 of the relay can be pumped down to a high vacuum (and, if desired, backfilled to a pressure of say three atmospheres with an insulating gas such as sulphur hexafluoride). Tube 30 is thereafter pinched off and sealed where it extends through an externally threaded boss 32 which receives nut 16.

Figure 6:
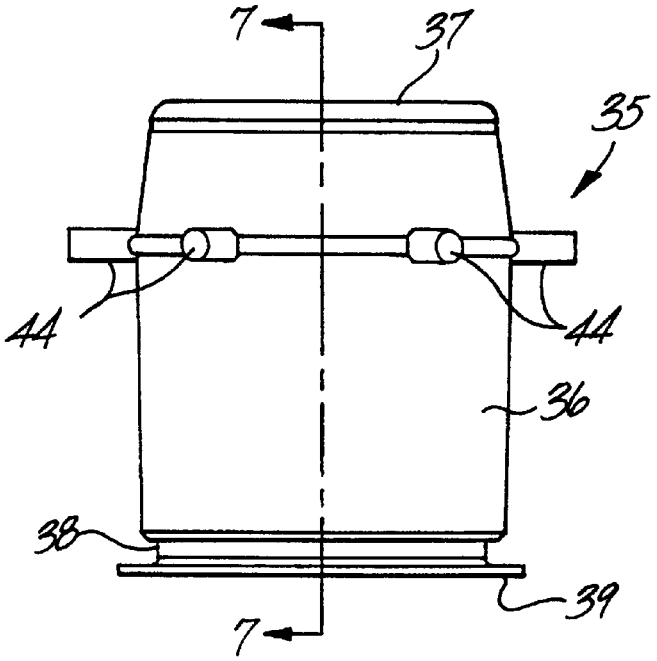
FIG. 6 is an elevation of a cylindrical assembly which supports terminal pins and fixed/movable contacts of the relay.
Figure 7:
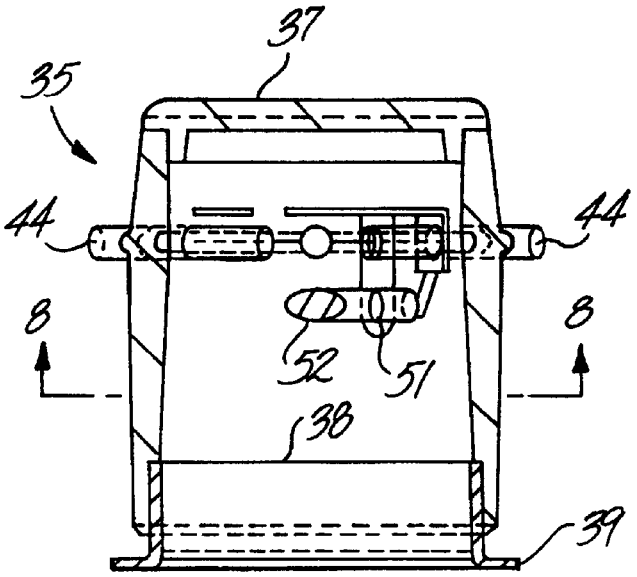
FIG. 7 is a sectional elevation on line 7—7 of FIG. 6.
Figure 8:
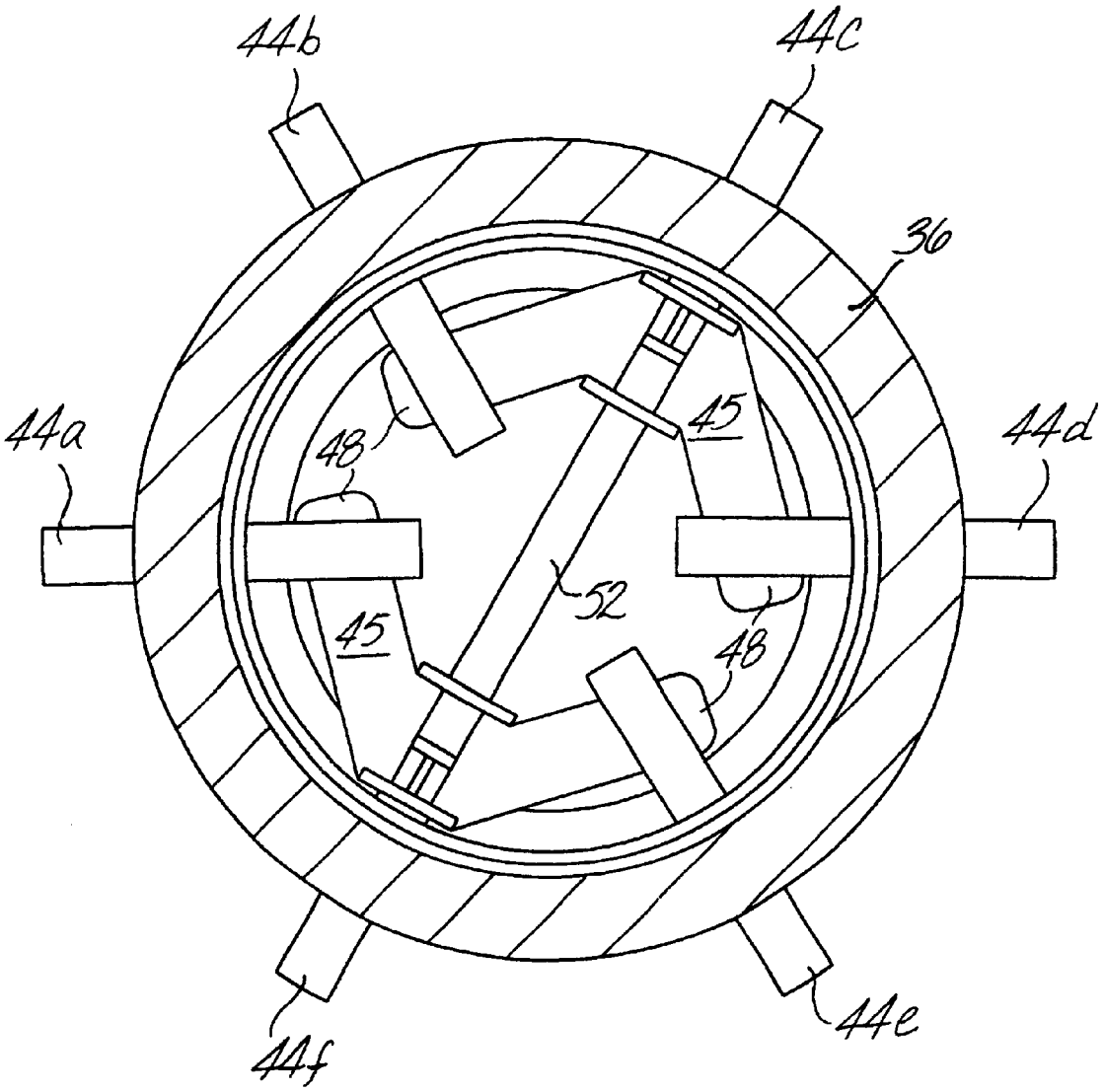
FIG. 8 is a bottom plan view on line 8—8 of FIG. 7.
Figure 9:
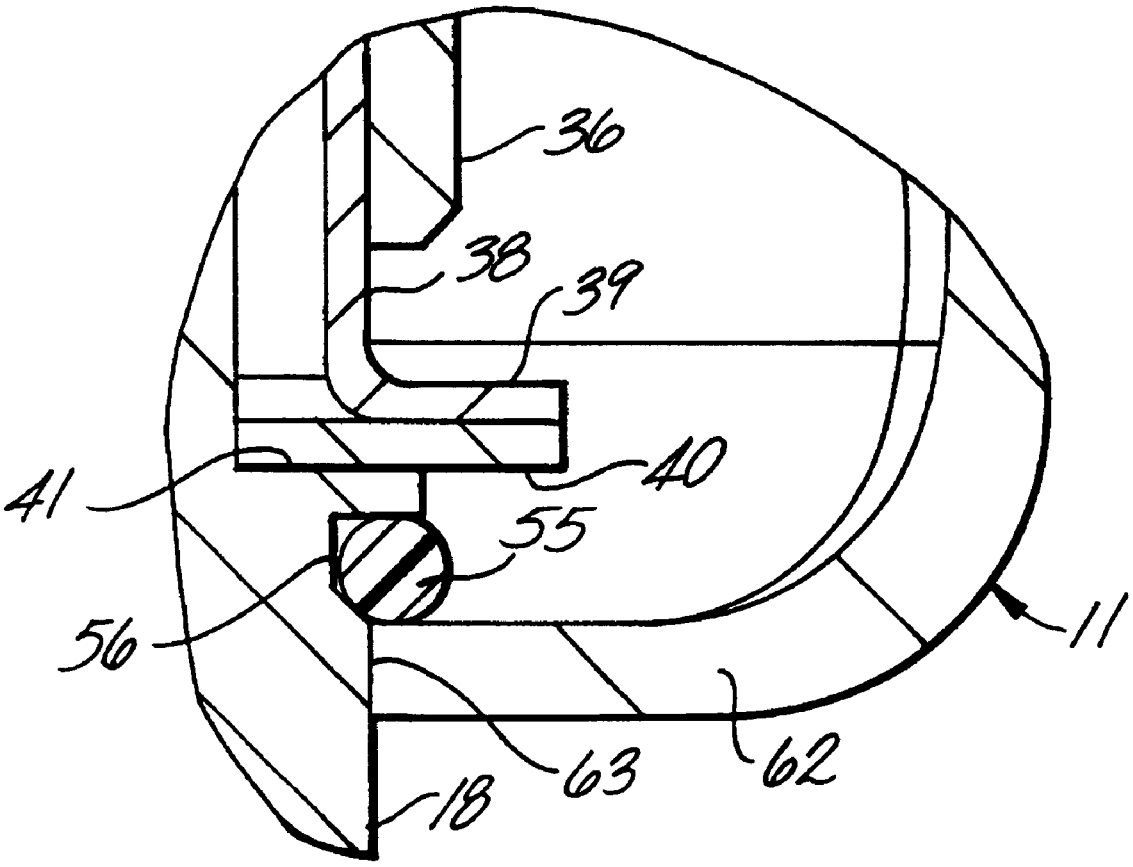
FIG. 9 is an enlarged elevation of detail shown in the lower-right corners of FIGS. 2 and 3.

Sealed chamber 31 is enclosed by base 14 and a hollow assembly 35 as best seen in FIGS. 6–8. Assembly 35 includes a generally cylindrical plastic sidewall 36, an upper closure cap 37 press fitted into the upper end of the sidewall, and a metal ring 38 press fitted into the lower end of the sidewall and having at its lower end an outwardly extending flange 39 which is brazed to a metal disk 40 which is in turn brazed to a disk 41 brazed to an inwardly extending annular shoulder 41 in the outer surface of base 14 (FIGS. 2 and 9). These brazed junctions hermetically seal the joined components.

Figure 4:
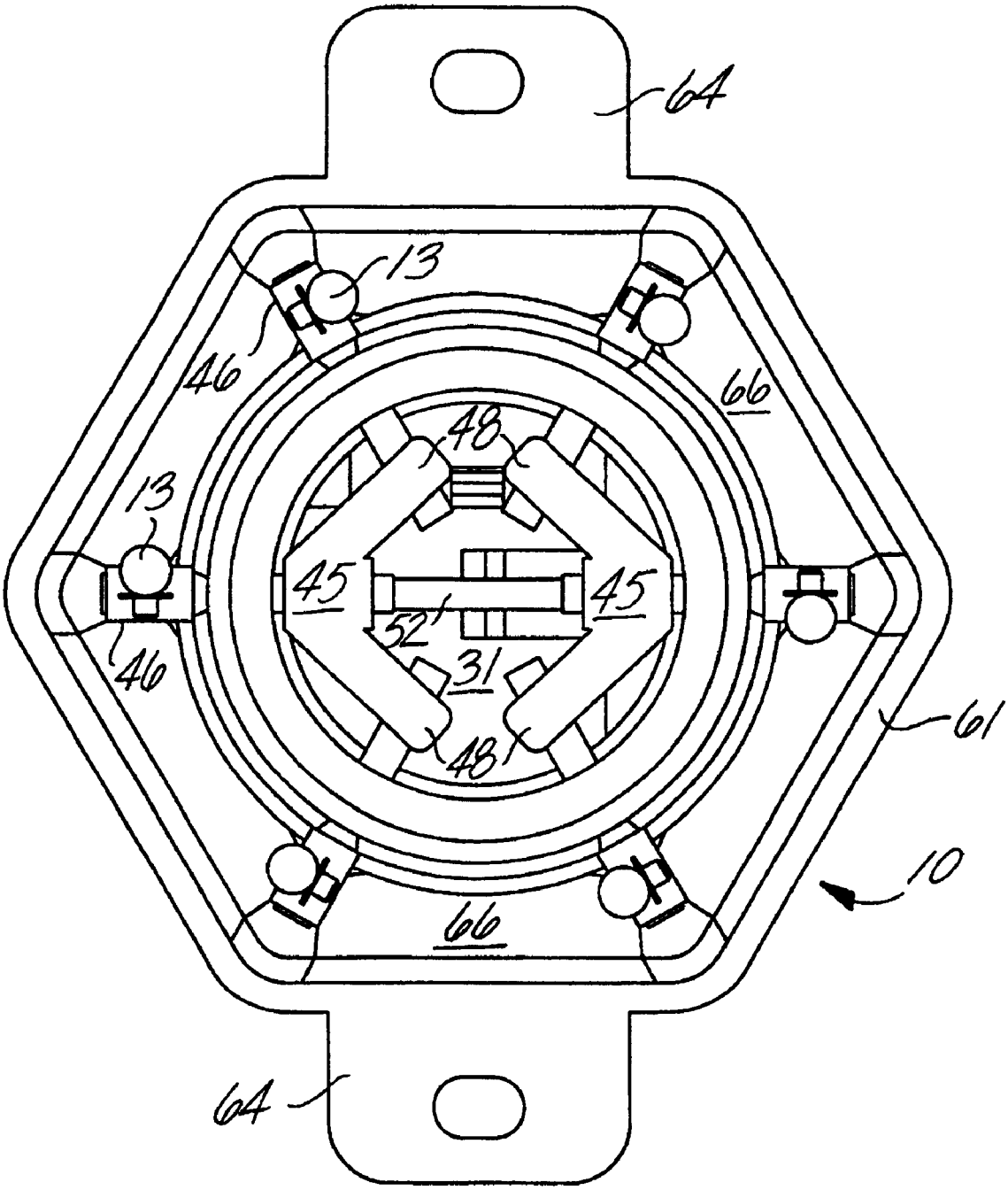
FIG. 4 is a top sectional view of the relay on line 4—4 of FIG. 2.

Six metal terminal pins 44*a–f* are radially spaced apart, and extend through sidewall 36 to form the six terminals of a DPDT switch. Pins 44 are fixtured in an injection mold in which plastic sidewall 36 is formed, and are thereby rigidly supported by the sidewall. Pins 44*a–b* and *d–e* form fixed contacts of the switch, and pins 44*c* and *f* are conductive posts on which a pair of movable contacts 45 (FIG. 4) are mounted. External leads 13 are secured to the pins by connectors 46 secured to the pins.

Each movable contact is Y-shaped in plan view (FIGS. 4 and 8) to define a pair of contact surfaces 48 which are urged against or away from one of the associated pair of fixed contacts in seesaw fashion when the relay is energized or deenergized. Each movable contact has a pair of downwardly extending inner and outer tabs 49 and 50 each having a hole at its upper end so the contact can be fitted over associated pin 44.

A lower hole 51 extends through each inner tab 49 to receive an insulated rod 52 which couples the movable contacts together. Rod 52 is fitted into slot 28 of armature leg 27 (FIG. 3), and is held captive between the movable contacts by a lower end 53 of each outer tab 50. This general style of fixed and movable contact assembly is conventional, and is described in greater detail in, for example, U.S. Pat. No. 3,604,870, the disclosure of which is incorporated herein by reference.

The relay is assembled by placing assembly 35 against base 14 with ring flange 39 against disk 40, and insulated rod 52 engaged in slot 28 of the armature leg. With cap 37 removed, proper alignment of the parts can now be checked by actuating the relay coil, and any necessary adjustments are made before welding ring flange 39 to disk 40. Cap 37 is then press fitted into sidewall 36, and an O-ring 55 is fitted into an annular groove 56 in the outer surface of base sidewall 18 beneath disk 40 (FIG. 9).

Figure 5:
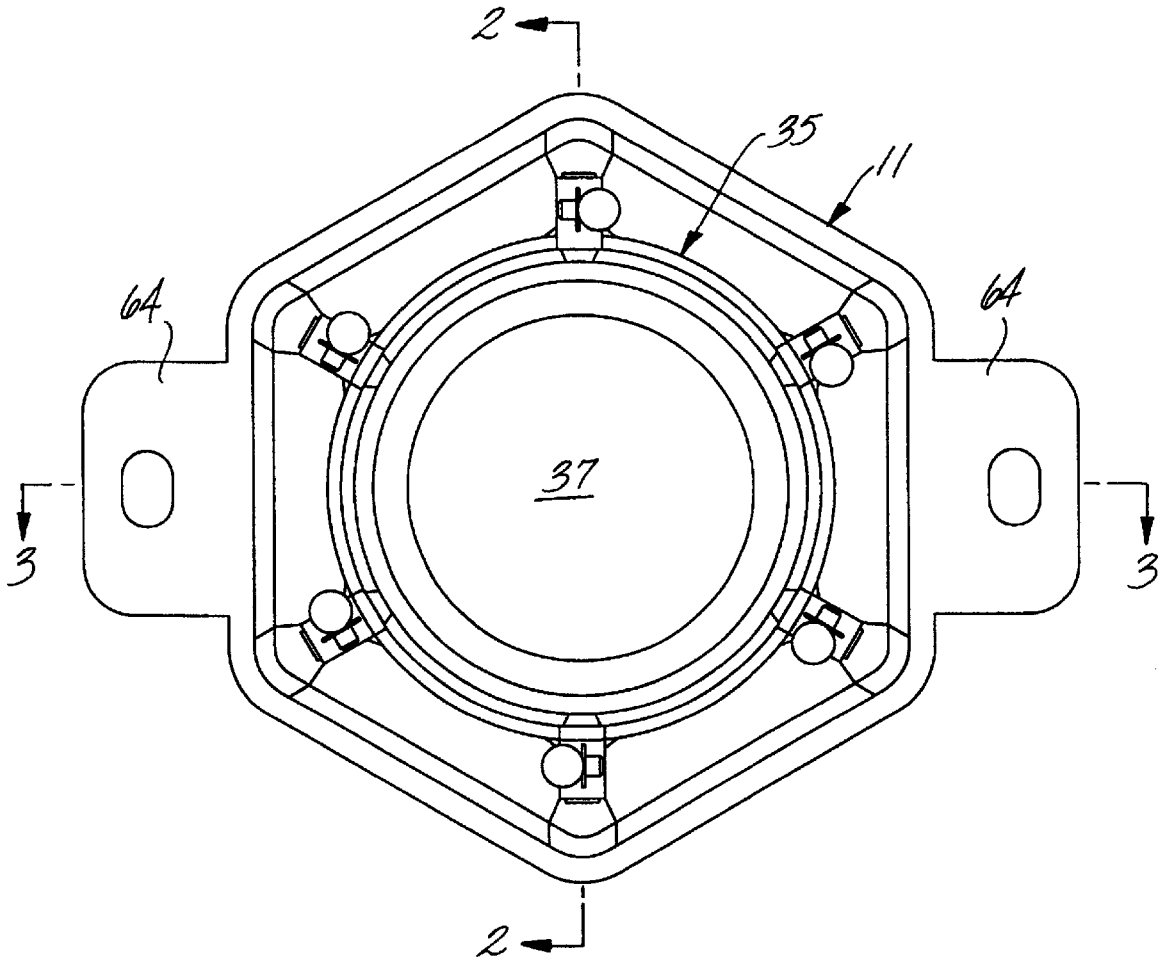
FIG. 5 is a top view of the assembly shown in FIG. 2.

Open-top plastic (Nylon 6/6 is a presently preferred material) potting cup 11 has a hexagonal sidewall 61 and a bottom wall 62 having a central circular opening 63 which receives the threaded lower end of base 14 as shown in FIGS. 2 and 8. Optional mounting tabs 64 (shown in FIGS. 3–5) may be integrally molded with the potting cup if desired. The potting cup is tightened on base 14 to compress O-ring 55 by temporarily tightening a nut (not shown) on the externally threaded part of the base against the cup.

With the assembly fixtured in an upright position, external leads 13 are supported to extend vertically from pins 44, and uncured epoxy 12 is then poured into a space 66 between the exposed outer surfaces of assembly 35 and base 14, and the inner surface of the potting cup. The epoxy also covers the top of assembly 35, and fills the potting cup as shown in FIG. 1. After conventional curing of the epoxy, the relay is evacuated (and, if desired, backfilled) through tube 30 which is then sealed by cold-weld pinch off, and the relay coil and associated cover plate 15 are secured in place by nut 16.

The body of encapsulating epoxy 12 forms a hermetic seal around all of the components which define sealed chamber 31. More specifically, hermetic seals are formed at the epoxy-to-metal junctions of the epoxy with pins 44 where they emerge from sidewall 36, with connectors 46, with the exposed portions of ring 38, disk 40 and sidewall 18 of the base. O-ring 55 is not relied on for a hermetic seal, and is instead used only to prevent leakage of uncured epoxy during the pouring and curing cycles.

Figure 11:
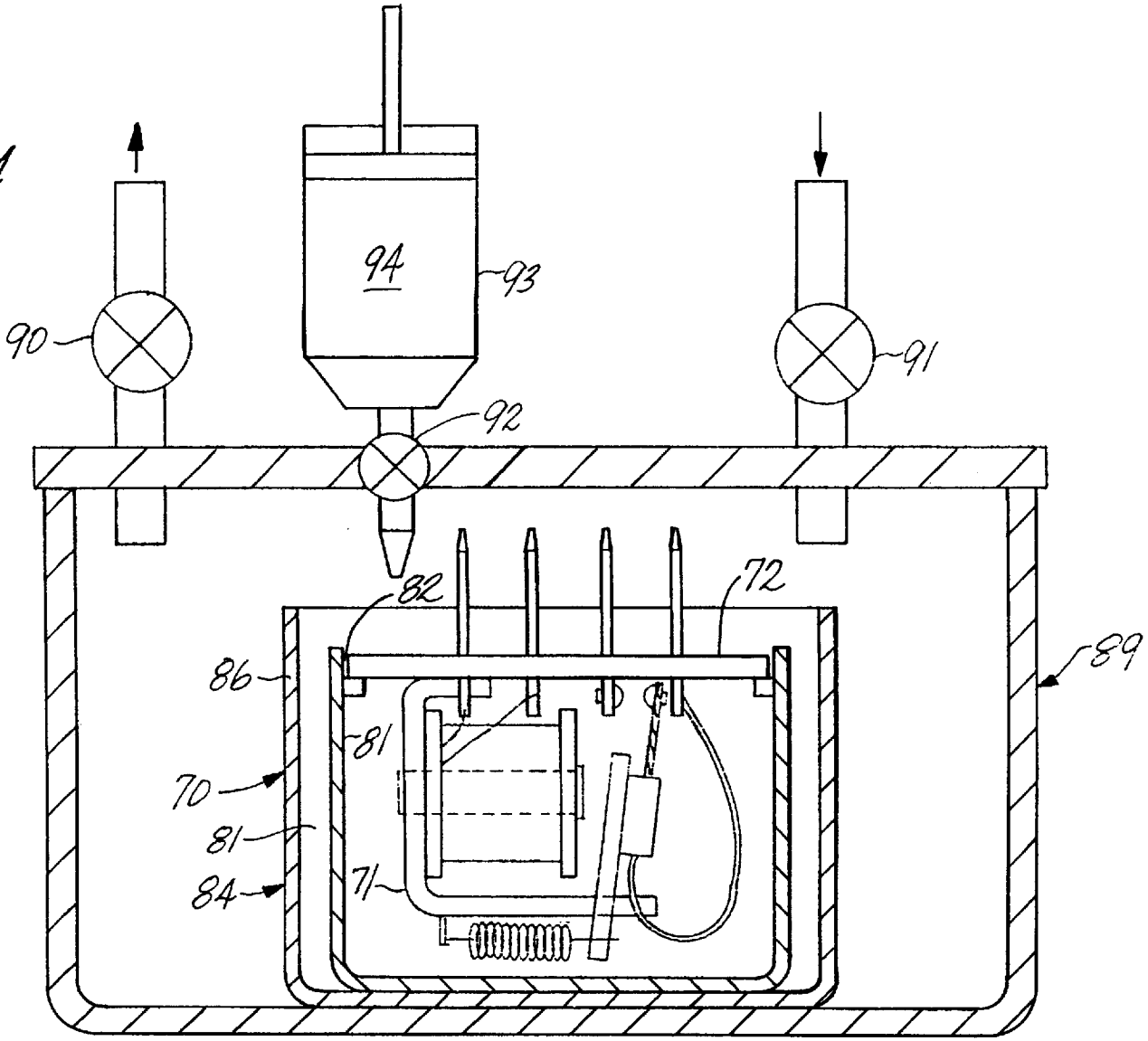
FIG. 11 shows the assembly of FIGS. 10A and B in a closed chamber having evacuation, pressurization and encapsulation-material valves.
Figure 12:
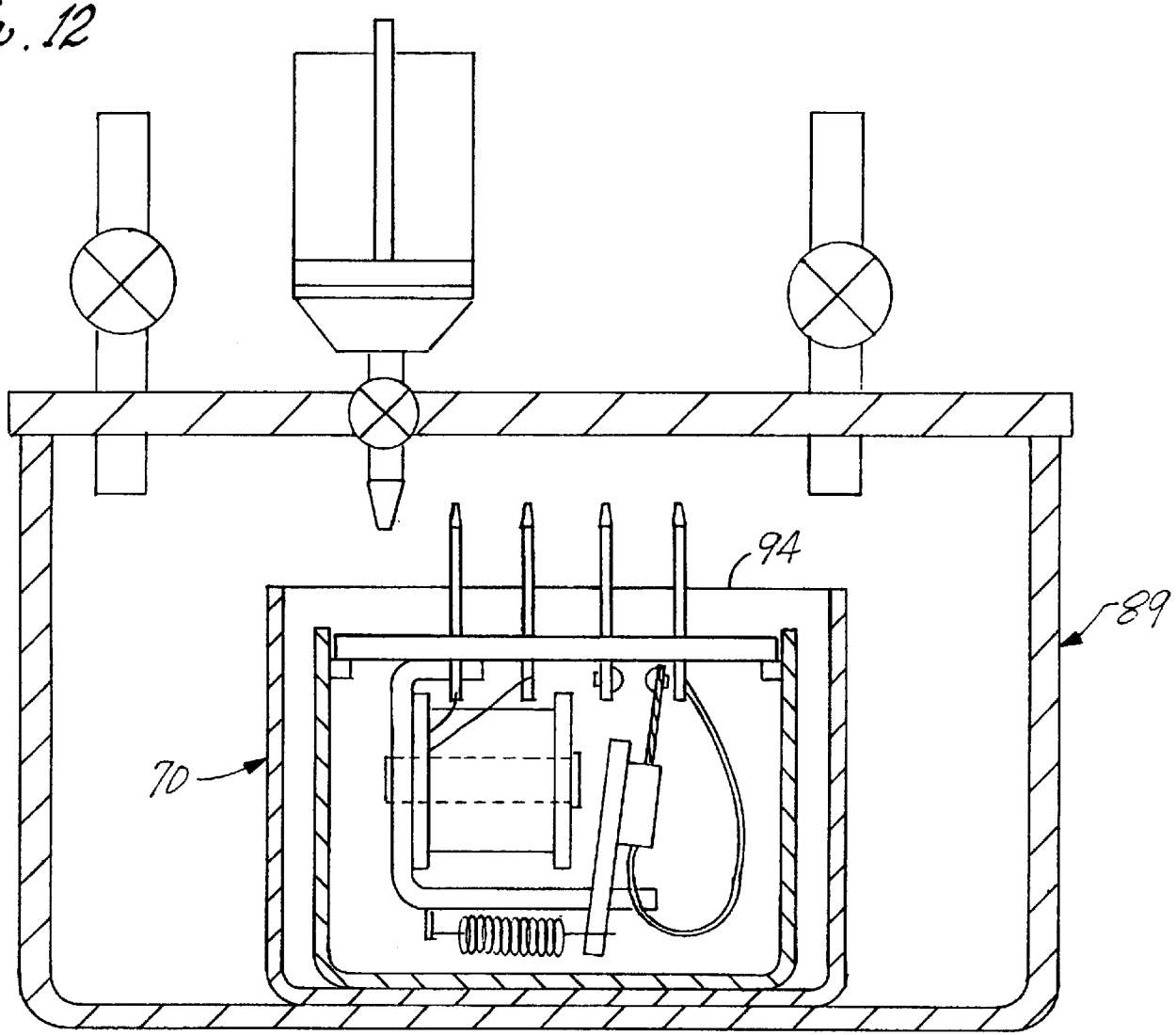
FIG. 12 is a view similar to FIG. 11, and showing the relay assembly filled with cured encapsulation material.

A second embodiment of a sealed relay according to the invention is shown in FIGS. 10–12, and this embodiment uses a simple and inexpensive open-frame relay in an open-top housing assembly which is evacuated, encapsulated and backfilled while positioned within a sealed chamber. This manufacturing method eliminates need for an evacuating and backfilling tubulation, and enables use of an inexpensive relay for high-voltage and high-power applications heretofore handled only by more expensive high-vacuum or pressurized units of known types as described in the introductory part of this specification.

Referring to FIGS. 10A and B, a relay assembly 70 is shown prior to encapsulation, and the assembly includes a conventional open-frame relay 71 (illustrated as a single-pole single-throw or SPST type, but other conventional contact configurations are equally useful) secured to and suspended from a generally rectangular header 72. Elongated metal terminal pins 73*a–d* extend through the header, and pins 73*a* and *b* are connected to a coil 74 of the relay electromagnetic actuator. Pin 73*c* supports a fixed contact 75, and pin 73*d* is connected to a movable contact 76 which is pulled against the fixed contact when the relay is energized. A coil spring 77 urges the movable contact into an open position in conventional fashion.

Relay 71 is positioned within an open-top plastic cup 79, with the underside of header 72 supported on short spaced-apart lugs 80 which extend inwardly from the inner perimeter of a sidewall 81 of cup 79 slightly below the top of the cup. The header does not make a snug press fit within the upper end of the cup, and there is instead an intentional narrow gap 82 of say 0.002–0.003 inch between the side edges of the header and the inner surface of sidewall 81.

Plastic cup 79 is in turn centrally fitted within an open-top metal cup 84 having a base 85 against which the plastic cup rests, and an upwardly extending sidewall 86. The plastic cup is smaller in external dimension than the interior of sidewall 86, creating a space or gap 87 between the plastic and metal cups. Sidewall 86 extends higher than the top of the plastic cup, and pins 73*a–d* in turn extend higher than the top of the metal cup. An acceptable alternative to metal cup 84 is a similarly shaped plastic cup having a separate metal plate resting on the cup bottom for bonding with encapsulation material.

The thus-assembled components are next placed in a sealed chamber 89 as shown in FIG. 11. The chamber has an evacuation valve 90 connected to a high-vacuum pumping system (not shown) of a conventional type using mechanical and diffusion pumps. The chamber also has a pressurization valve 91 connected to a pressurized source (not shown) of an insulating gas such as $SF_6$. The chamber further has a third valve 92 positioned above cup 84, and connected to a piston-cylinder assembly 93 for holding and delivering a metered amount of uncured viscous, but fluid encapsulating material 94.

Evacuation valve 90 is then opened, and the high-vacuum pumping system actuated to withdraw air from the chamber interior to a vacuum which is preferably at least $10^{-2}$ to $10^{-3}$ Torr if the relay is to be backfilled. Ambient air is simultaneously withdrawn from relay assembly 70 through gap 82 between header 72 and sidewall 81. Valve 90 is closed when a desired vacuum is achieved.

Open-frame relays are unsuited for long-term vacuum operation due to outgassing of components such as the relay coil which will eventually contaminate and adversely affect a high-vacuum environment. This problem is eliminated by backfilling and pressurizing the chamber and as-yet-unsealed relay assembly with an insulating gas which is admitted by opening pressurization valve 91. The gas flows freely through gap 82 to fill and pressurize the interior of the relay assembly.

With the chamber interior stabilized in a high-pressure condition, valve 90 is closed, valve 92 is opened, and piston-cylinder assembly 93 actuated to deliver at a pressure exceeding that of the pressurized chamber a metered amount of fluid encapsulating material into metal cup 84 to completely fill gap 87 and cup 84 to a level just beneath the top of sidewall 86 as shown in FIG. 12. The encapsulating material is too viscous to pass through small gap 82, and the backfilled environment within the relay assembly remains undisturbed.

Preferably, chamber 89 is of a conventional type which includes a heater such as an induction heater, and heat is applied to the now-encapsulated relay assembly to cross link and cure the encapsulating material. With the chamber vented to atmosphere, the completed relay assembly is removed for testing and packaging. In production, many relay assemblies would be processed in a single loading of the chamber, and the methods of the invention can also be adapted for use in a continuous production line.

The optimum environment in which the relay contacts make and break is dependent upon the required performance of the relay. Vacuum (less than $10^{-5}$ Torr) is generally a good environment for high-voltage applications, but would not be chosen for applications where relay components in the vacuum environment might outgas. There are many gases that can be used to improve electrical performance of a relay. Sulfur hexafluoride ($SF_6$) is a good dielectric gas which at higher pressure will standoff significantly higher voltages than open air. A relay that will standoff 5 kilovolts in open air will standoff 40 kilovolts if it is pressurized with 10 atmospheres of $SF_6$. Another characteristic of $SF_6$ is that once ionized it becomes an excellent conductor. This makes it a good choice for relays that need to make into a load and keep consistent conduction of current while the load is being discharged. It is not a good gas, however, if that load needs to be interrupted, because the $SF_6$ will tend to continue conduction, and prevent the load from being interrupted.

Hydrogen (and hydrogen-nitrogen blends) has been shown to effectively cool the electrical arc that is created when the electrical contacts move away from each other while breaking a load. The difficulty with hydrogen is that not only is it the smallest molecule so that it will propagate through the smallest cracks, but it can also chemically propagate through many materials. The design of the present invention using cross-linked polymers, unlike other designs, will hold pressurized hydrogen gas for many years.

There are several kinds of epoxy materials which bond satisfactorily with metal and, which are impermeable to prevent leakage of air into a vacuum relay, or loss of insulating gas in a pressurized relay. A presently preferred material is commercially available under the trademark Resinform RF-5407(75% alumina filled) mixed 100:12 by weight with Resinform RF-24 hardener. Alternative epoxy materials should provide these characteristics:

a. Low gas permeability (less than $10^{-10}$ standard cubic centimeters of air per second).
b. High dielectric strength (greater than 100 volts per mil).
c. Low outgassing (to maintain a vacuum of $10^{-5}$ Torr or better).
d. Good mechanical strength.
e. Thermal expansion characteristics reasonably matched to those of the metal with which the epoxy forms a hermetic seal.

There have been described several embodiments of epoxy envelopes for hermetically sealing standard relay designs in a special atmosphere for improved performance. These envelopes provide significant cost savings in the manufacture of vacuum or pressurized sealed relays, and have performance characteristics at least equivalent to relays of this type using glass or ceramic envelopes. The invention is not limited to the specific relay types described above, and is equally useful with other switching devices such as reed-style relays and the like.

We claim:

1. A sealed electromagnetic relay assembly comprising:

a relay having a plurality of leads for connection to external circuitry;

a hermetically sealed housing assembly enclosing the relay, the housing assembly comprising:

a base supporting the relay; the base including an evacuation tube, the evacuation tube being in fluid communication with an interior chamber of the housing assembly, wherein ambient air may be evacuated from the housing assembly to a vacuum within the range of about $10^{-5}$ Torr or less and wherein the housing assembly after evacuation is backfilled with an insulative gas to a pressure of 1.5 atmospheres, a hollow assembly attached to the base, the hollow assembly defining an interior chamber surrounding the relay;

terminal pins connected to the relay leads, the pins extending through a wall of the hollow assembly;

an upper closure, the upper closure being attached to and closing off the hollow assembly; and an impermeable potting cup surrounding the sealed housing assembly, the potting cup being adapted to receive the base at one end and being open at the other end for the receipt of encapsulating material, wherein the encapsulating material seals the housing assembly, and the relay leads extending outward from the housing assembly, against ambient air intrusion.

2. The sealed electromagnectic relay of claim 1, wherein the hollow assembly further comprises a hollow cylindrical upper plastic portion which is press fit into a metal ring.

3. The sealed electromagnectic relay of claim 2, wherein the base member is of generally circular configuration, the base member being formed of metal and attached to the hollow assembly by brazing.

4. The sealed electromagnectic relay of claim 2, wherein the base member further includes an o-ring groove and an o-ring disposed within the o-ring groove, wherein the base is received within the impermeable potting cup such that the cup seals against the o-ring, wherein uncured potting material is prevented from leaking from the joint between the potting cup and the base.

* * * * *